US005819312A

United States Patent [19]

Snyder et al.

[11] Patent Number: 5,819,312

[45] Date of Patent: Oct. 13, 1998

[54] HAND PROTECTION DEVICE

[76] Inventors: Randy Bruce Snyder, 7763 W. 62nd Way, Arvada, Colo. 80004; Jason Michael Johnson, 4311 Heather Ridge Dr., Wilmington, N.C. 28405

[21] Appl. No.: 688,624

[22] Filed: Jul. 30, 1996

[51] Int. Cl.[6] ..... A41D 13/08; A41D 19/00

[52] U.S. Cl. ..... 2/16; 2/20; 2/160; 2/161.1; 2/161.6; 2/162; 2/167

[58] Field of Search ..... 2/19, 20, 24, 160, 2/161.1, 159, 161.2, 161.3, 161.4, 161.5, 161.6, 161.7, 161.8, 162, 163, 164, 165, 166, 167, 168, 169, 170, 267, 455, 459, 460, 462, 463, 464, 465, 466

[56] References Cited

U.S. PATENT DOCUMENTS

| | | | |
|---|---|---|---|
| Re. 32,566 | 12/1987 | Patton, Jr. | 2/20 |
| D. 324,435 | 3/1992 | Jeronimo, Jr. | D29/22 |
| D. 327,754 | 7/1992 | Hochgesang et al. | D29/21 |
| D. 328,369 | 7/1992 | Hong | D29/22 |
| 2,266,886 | 12/1941 | McCoy | 2/24 |
| 3,779,550 | 12/1973 | Benoun et al. | 2/170 |
| 3,943,923 | 3/1976 | Scheinberg | 128/89 R |
| 3,994,025 | 11/1976 | Petroski | 2/20 |
| 4,042,975 | 8/1977 | Elliot, Jr. et al. | 2/19 |
| 4,051,553 | 10/1977 | Howard | 2/20 |
| 4,121,824 | 10/1978 | Hirschfield | 273/26 |
| 4,176,407 | 12/1979 | Goebel et al. | 2/20 |
| 4,461,043 | 7/1984 | Lomedico | 2/21 |
| 4,676,233 | 6/1987 | Scheinberg | 128/87 R |
| 4,700,405 | 10/1987 | Sternberg | 2/19 |
| 4,768,234 | 9/1988 | Yamamoto | 2/161 A |
| 4,864,660 | 9/1989 | Sawyer | 2/161 A |
| 4,923,418 | 5/1990 | Hoffman | 441/57 |
| 4,930,162 | 6/1990 | Côté | 6/161 A |
| 5,159,717 | 11/1992 | Drew et al. | 2/20 |
| 5,218,719 | 6/1993 | Johnson | 2/19 |
| 5,285,529 | 2/1994 | Arena | 2/20 |
| 5,295,269 | 3/1994 | Ballard | 2/18 |
| 5,345,609 | 9/1994 | Fabry et al. | 2/20 |
| 5,379,459 | 1/1995 | Williams, Jr. | 2/19 |
| 5,604,931 | 2/1997 | Rhoades | 2/19 |

*Primary Examiner*—Jeanette E. Chapman
*Attorney, Agent, or Firm*—Sheridan Ross P.C.

[57] ABSTRACT

A hand protection device for at least partially absorbing and distributing impact forces is disclosed. The hand protection device includes a deformable metal plate capable of covering and conforming to at least a portion of the back side of an individual's hand. The device is designed for use on the back side of an athletic glove.

46 Claims, 11 Drawing Sheets

HAND PROTECTION DEVICE

FIELD OF THE INVENTION

The present invention relates generally to the field of hand protection devices, and more particularly to hand protection devices which absorb and distribute impact forces on the hands.

BACKGROUND OF THE INVENTION

Athletic gloves (e.g., batting gloves) having devices for protecting the back of an individual's hand are described in U.S. Pat. Nos. 4,864,660 and 5,345,609. In such gloves, protection devices generally consist of a flexible cushioning pad which provides the user (e.g., baseball batter) with a lightweight and comfortable hand protector capable of at least partially absorbing impacts from, for example, pitched baseballs. In this regard, such protection devices do not unduly inhibit a batter's performance as such devices are typically flexible. However, such devices tend to lose the ability to fully recover from compression. In this regard, the ability of such devices to absorb impact forces over time and use decreases. Furthermore, such devices do not effectively distribute impact forces over a broad area.

Rigid protection devices have also been utilized to protect the back side of an athlete's hands from impact forces, as exemplified in U.S. Pat. No. 4,042,975. In this device, a hard protective plate for batting gloves is made from a rigid plastic material. A protective plate fabricated from such rigid plastic is lightweight and provides high impact strength. However, such rigid protective plates may be uncomfortable as such rigid plates are not custom fittable to specific athletes. In this regard, such rigid plates are not readily bendable (e.g., deformable without fracture) to conform to the unique size and contours of the back side of each athlete's hand. As a result of such discomfort, a batter's ability to concentrate on forthcoming pitched balls may be inhibited.

U.S. Pat. No. 4,768,234 discloses a ski glove having a number of protective plates on the ski glove to protect finger and back portions of a skier's hand, as well as wrist and forearm portions of the skier. Such gloves are most suited to competitive skiing, motorcross or other races in which racers have the possibility of damaging a hand and a back of a forearm when the racer collides against an obstacle or turns over. In this regard, as speed is of the essence in ski races such as the slalom, such plates are primarily directed to decreasing time loss in a race by reducing frictional resistance between such plates and the gates on the slalom run. The ski glove of U.S. Pat. No. 4,768,234 may also relieve the back portion of a skier's hand from the resultant impacts between the skier's hand and slalom gates. In this regard, the back portion of the ski glove is provided with two hard-material plates, which are radially disposed relative to each other and spaced apart to accommodate grasping motions of a skier's hand. While the two hard material plates may be capable of absorbing impact forces and may provide a degree of comfort to the user in grasping actions, the ski glove may not be sufficient for purposes of protecting the entire back side or even specific areas of the back side of the hand in view of the substantial gap between the two radially disposed, spaced-apart plates. Furthermore, the skier's glove does not adequately protect the side (e.g., medial and posterior sides) of the fifth metacarpal bone. In this regard, significant damage to certain portions of the back and side of the hand may result, especially in instances where an object (e.g., bat) is gripped by the user, as such grasping would appear to widen the gap between the two plates. Furthermore, impact forces would not appear to be distributed over a significant portion of the back side of the hand as each of the two spaced-apart plates covers an area significantly smaller than the back side of the hand. In this regard, there is no disclosure that the two spaced apart, hard-material plates on the back of the ski glove would be sufficient for purposes of protecting the back and side of a hand against small projectiles (e.g., baseballs), nor is there any disclosure that such plates would be capable of absorbing and sufficiently distributing an impact force from a pitched baseball, nor is there any suggestion that the two spaced apart plates function to evenly distribute impact forces from a pitched baseball.

Accordingly, it is a primary object of the present invention to provide a lightweight hand protection device.

It is a further object of the present invention to provide a custom fittable hand protection device which does not unduly inhibit the user of the device.

It is yet another object of the present invention to provide a hand protection device capable of at least partially absorbing and distributing impact forces on a back side of an individual's hand.

It is another object of the present invention to provide a hand protection device capable of at least partially absorbing and distributing impact forces about the fifth metacarpal bone of the hand.

It is a further object of the present invention to provide a protection device capable of at least partially absorbing and distributing impact forces on a wrist area of an individual.

SUMMARY OF THE INVENTION

In accordance with the present invention, a hand guard for protecting at least a metacarpal area of the hand is provided. In one aspect, the hand guard comprises a material capable of absorbing and distributing impact forces over a broad area. Such hand guards are useful in athletic events in which projectiles are either thrown or hit (e.g., tennis, racquetball, squash, hockey). In this regard, such hand guards are especially useful for protecting the lead hand of batters from pitched balls (e.g., baseballs, softballs).

In one embodiment, the hand guard device comprises a unitary, deformable (e.g., easily bendable without fracture) metal plate for covering at least the fourth and fifth metacarpal bones of the hand. In this regard, the plate comprises a sheet of soft, malleable, untempered metal which is easily bendable. The metal plate is thus custom fittable as the metal plate may be easily bent without fracture to conform to a contour in a metacarpal area on the back side of a selected individual's hand. For purposes of providing increased comfort and absorbability of impact forces, the hand guard may further comprise at least one flexible resilient substrate attachable to at least one of the upper and lower surfaces of the deformable metal plate.

In another embodiment, the present invention provides a glove for protecting at least a back portion of an individual's hand. The glove can comprise a back glove portion which covers at least a metacarpal area on the back portion of the hand, a bendable (e.g., deformable) metal plate which is conformable to cover at least the fourth and fifth metacarpal bones of the hand, and a holding member for securing the plate on the back glove portion. In one embodiment, for purposes of enhancing absorption of impact forces and comfort to the user of the glove, the glove may further comprise at least one cushioning substrate, which is attachable to at least one of the upper and lower surfaces of the plate.

The holding member, which is attachable to at least one of the back glove portion and the plate, secures the plate on the back glove portion such that at least the fourth and fifth metacarpal bones are covered and thus, protected by the plate. In one embodiment, the holding member for securing the plate to the back glove portion includes at least one fastener, such as stitching, a snap, a strap, Velcro or an adhesive. In another embodiment, the holding member is a sleeve (e.g., pocket) on the back glove portion. In this embodiment, the sleeve is capable of receiving and retaining the plate therein. The sleeve may be built into the glove such that the plate is permanently fixed to the glove (e.g., stitched) or releasably secured to the back glove portion via a securing means comprising a selectively releasable fastener (e.g., snaps, straps, Velcro or an adhesive).

In another aspect, for purposes of protecting a wrist portion of an individual, proximate a metacarpal area of the individual's hand (e.g., carpal bones and distal positions of ulna and radius bones), the present invention also contemplates providing a glove to protect at least a wrist portion of an individual. In this regard, the glove can include front and back glove portions covering at least a portion of the front and back sides of a hand of the individual, a readily bendable (e.g., deformable without fracture) metal wrist plate conformable to cover at least a portion of the wrist and a holding member for securing the wrist plate on the back glove portion, proximate the wrist (e.g., proximal to the wrist). In one embodiment, for purposes of enhancing comfort and impact force absorbability, the glove may further include at least one wrist cushioning substrate attachable to one of the upper and lower surfaces of the wrist plate.

The holding member, which can be attachable to at least one of the front and back glove portions and the wrist plate, functions to secure the wrist plate to the back glove portion, proximate a wrist portion of the individual. For purposes of providing a wrist plate which is conformable to a contour in the wrist portion of the individual (e.g., custom fittable), the holding member may allow the wrist plate to bend accordingly. In one embodiment, the wrist plate is attachable to the back glove portion via a fastener (e.g., stitching, snaps, straps, Velcro or an adhesive). In another embodiment, the holding member is a wrist strap attached to one of the front and back glove portions. In this regard, the wrist plate is associated with (e.g., retained within a pocket formed by the wrist strap or attached to the wrist strap via a releasable fastener, such as Velcro, an adhesive or a snap) a wrist strap which is commonly used to secure the glove on the individual's hand, about the wrist. In another embodiment, the wrist plate is permanently attached to the glove.

For purposes of protecting a hand portion, and specifically, a metacarpal area on the back side of an individual's hand, the wrist protection glove may further include a hand plate for covering at least the fourth and fifth metacarpal bones of the hand and an attaching member for securing the hand plate on the back glove portion, proximate (e.g., proximal) the fourth and fifth metacarpal bones. Substantially as described hereinabove, the hand plate is a lightweight material capable of being deformed such that the hand plate is custom fittable (e.g., manually conformable) to a contour on the back side of the hand. In addition, substantially as described hereinabove, the attaching member can include a fastener, such as stitching, snaps, straps, Velcro or an adhesive. Furthermore, in order to secure the hand plate on the back glove portion to conform to and protect at least the fourth and fifth metacarpal bones, the attaching member is preferably flexible. In this regard, the attaching member may include a Velcro-type interconnection (e.g., a plurality of hooks associated with the hand plate and an plurality of loops associated with the back glove portion).

DETAILED DESCRIPTION

FIGS. 1–13 illustrate a hand protection device embodying various features of the present invention. Generally, the hand protection device comprises a lightweight, malleable (e.g., manually deformable without fracture) metal plate 10 for covering at least a portion of the back side of a hand of an individual (e.g., baseball or softball batter, tennis, squash or racquetball player, lacrosse players, hockey players etc.). For purposes of substantially inhibiting severe damage (e.g., fracture) to at least the fourth and fifth metacarpal bones, the plate 10 is capable of at least covering and partially absorbing impact forces resulting from contact with another object. Furthermore, the bendable or deformable (e.g. malleable) metal plate is capable of distributing such impact forces over a broad area of the back side of the hand of the individual. In this regard, the plate 10 functions to protect a metacarpal area (e.g., fourth and fifth metacarpal bones, second through fifth metacarpal bones, first through fifth metacarpal bones) of a batter's hand against impact forces from projectiles, such as pitched baseballs.

Figure 1:
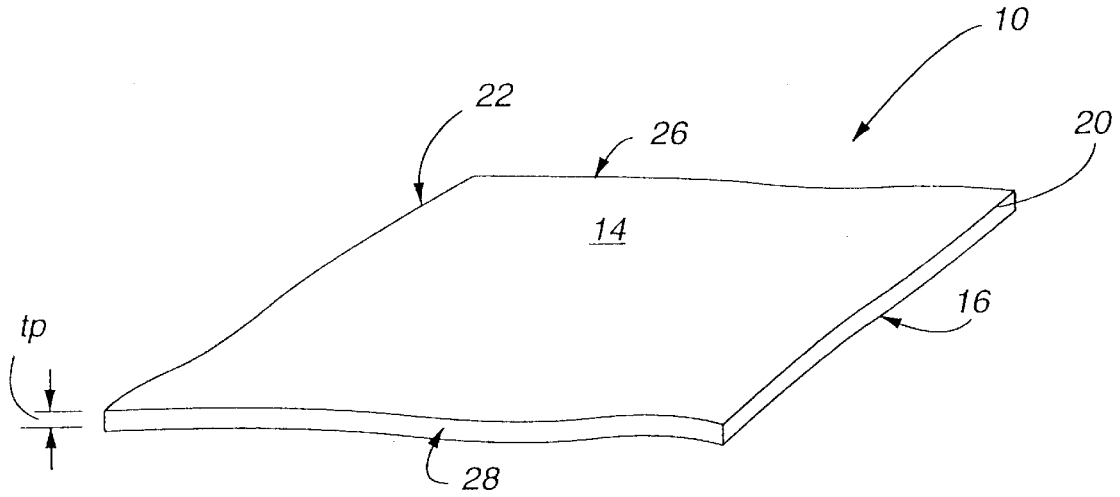
FIG. 1 is a perspective view of a hand protection guard according to the present invention.
Figure 2:
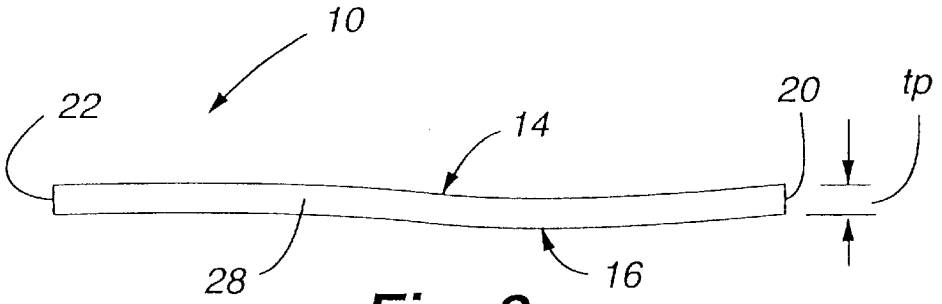
FIG. 2 is an end view of the hand protection guard illustrated in FIG. 1.
Figure 3:
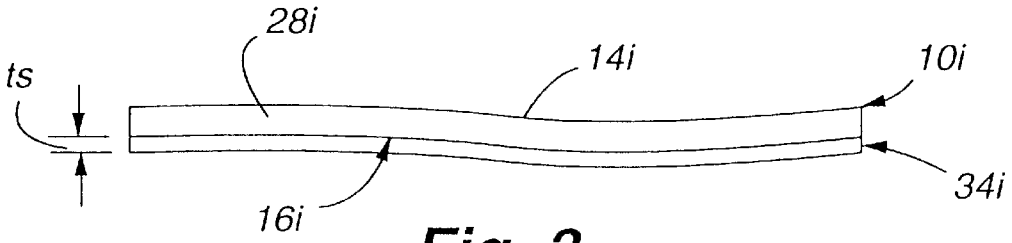
FIG. 3 is an end view of another embodiment of the hand protection guard.
Figure 4:
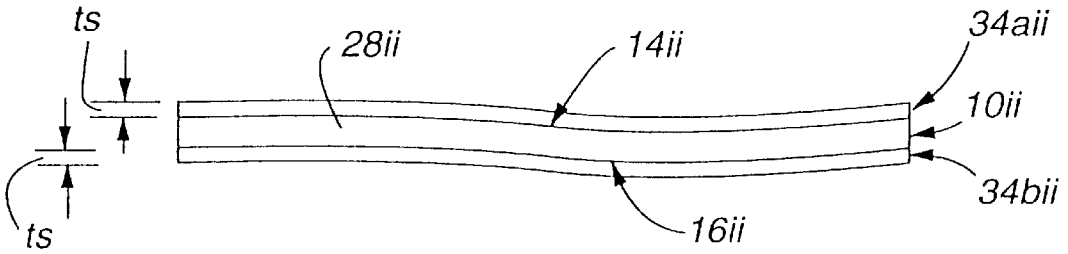
FIG. 4 is an end view of yet another embodiment of the hand protection guard.

The malleable metal plate 10, illustrated in FIG. 1, may be configured to cover at least a portion of the back side of an individual's hand. In this regard, the plate 10 generally comprises upper and lower surfaces 14, 16 which extend between laterally displaced side edges 20, 22 and longitudinally displaced top and bottom edges 26, 28. For purposes of protecting at least the fourth and fifth metacarpal bones of the back side of the hand, the side edges 20, 22 cover at least the fourth and fifth metacarpal bones. In a preferred embodiment, in order to sufficiently protect the fifth metacarpal, the plate 10 is sized such that one of the side edges 20, 22 is manually deformable to extend over (e.g., wrap about) the medial and posterior aspect of the fifth metacarpal (as will be described in more detail hereinbelow). Furthermore, the plate 10 may be sized such that the top and bottom edges 26, 28 of the plate 10 extend between an area proximate (e.g., proximal) the knuckles and an area proximate (e.g., proximal) the wrist portion of an individual.

For purposes of providing a "custom fit" hand protection device, the bendable metal plate 10 is deformable such that the plate 10 may generally conform to contours of the back side of an individual's hand. In this regard, the plate 10 may be fabricated from a thin sheet of soft, lightweight malleable metal. In one embodiment, the plate 10 is fabricated from a sheet of soft metal, such as aluminum. In another embodiment, the plate 10 is fabricated from a soft metal having a yield strength of less than about 60 ksi, and, in a preferred embodiment, a yield strength of less than about 40 ksi (e.g., aluminum, aluminum alloys, magnesium, and combinations thereof). In a preferred embodiment, the plate 10 is fabricated from aluminum. Furthermore, for purposes of providing a metal plate 10 which at least partially absorbs and distributes impact forces and is easily bendable by hand to a desired contour such that an individual may custom fit a plate 10 to the back of the individual's hand, the plate 10 preferably has a thickness "$t_p$", defined by the upper and lower surfaces 14, 16, of at least about 0.005 inches, and preferably, between about 0.005 inches to about 0.025 inches. In this regard, the plate 10 is readily conformable to the contour of the back side of an individual's hand and does not substantially inhibit an individual's hand actions (e.g., grasping an object, such as a baseball bat, racquet, hockey stick etc.). As such, one of the side edges 20, 22 may be easily bent and deformed about (e.g., wrapped over) an individual's fifth metacarpal to protect the posterior and medial portions of the fifth metacarpal from impact forces, substantially as shown in FIG. 7.

In another embodiment of the present invention, for purposes of providing increased comfort and shock absorbability, the hand protection device may further comprise at least one padding member attachable to at least one of upper and lower surfaces 14, 16 of the plate 10. In one embodiment, illustrated in FIG. 3, the padding member includes a substrate of cushioning material $\mathbf{34}_i$, which is attached to the lower surface $\mathbf{16}_i$ of the plate $\mathbf{10}_i$ to partially absorb impact forces, along with the plate $\mathbf{10}_i$. In this regard, increased comfort is provided to the individual as the cushioning substrate $\mathbf{34}_i$ is interposed between the plate $\mathbf{10}_i$ and the back side of the individual's hand. In another embodiment, illustrated in FIG. 4, cushioning substrates $\mathbf{34}a_{ii}$, $\mathbf{34}b_{ii}$ are attached to the upper and lower surfaces $\mathbf{14}_{ii}$, $\mathbf{16}_{ii}$ of the plate $\mathbf{10}_{ii}$. In this embodiment, cushioning substrates $\mathbf{34}a_{ii}$, $\mathbf{34}b_{ii}$ function to partially absorb impact forces, along with the plate $\mathbf{10}_{ii}$. In yet another embodiment (not shown), a first cushioning substrate is attached to the top surface of the plate such that the plate is interposed between the cushioning substrate and the hand.

For purposes of providing custom fit hand protection device (e.g., bendability), the cushioning substrates 34 may be fabricated from a flexible material. Additionally, the cushioning substrate 34 be composed of a resilient padding member capable of at least partially absorbing impact forces. In this regard, the cushioning substrates 34 may comprise a flexible material, such as foam, leather, textile and plastic. In a preferred embodiment, the substrates 34 are fabricated from a foam which may be either a closed-cell type or an open-cell type, such as polyurethane, neoprene, urethane foam (e.g., microcellular), expanded ethylene acetate microfoam material, or ethyl vinyl acetate. In order to provide a resilient, cushioning substrate 34 capable of at least partially absorbing impact forces while not substantially inhibiting an individual's hand actions (e.g., grasping), a thickness, "$t_s$", of the substrate 34, as defined by upper and lower surfaces of the substrate 34, is at least about 0.03125 inches, and, in a preferred embodiment, at least about 0.125 inches. In order to provide a hand protection device having a metal plate 10 and a cushioning substrate 34 attached to at least one of the upper and lower surfaces 14, 16 of the plate 10, an adhesive (e.g., glue, epoxy adhesive) may be used to affix the substrate 34 to the plate 10.

Figure 5:
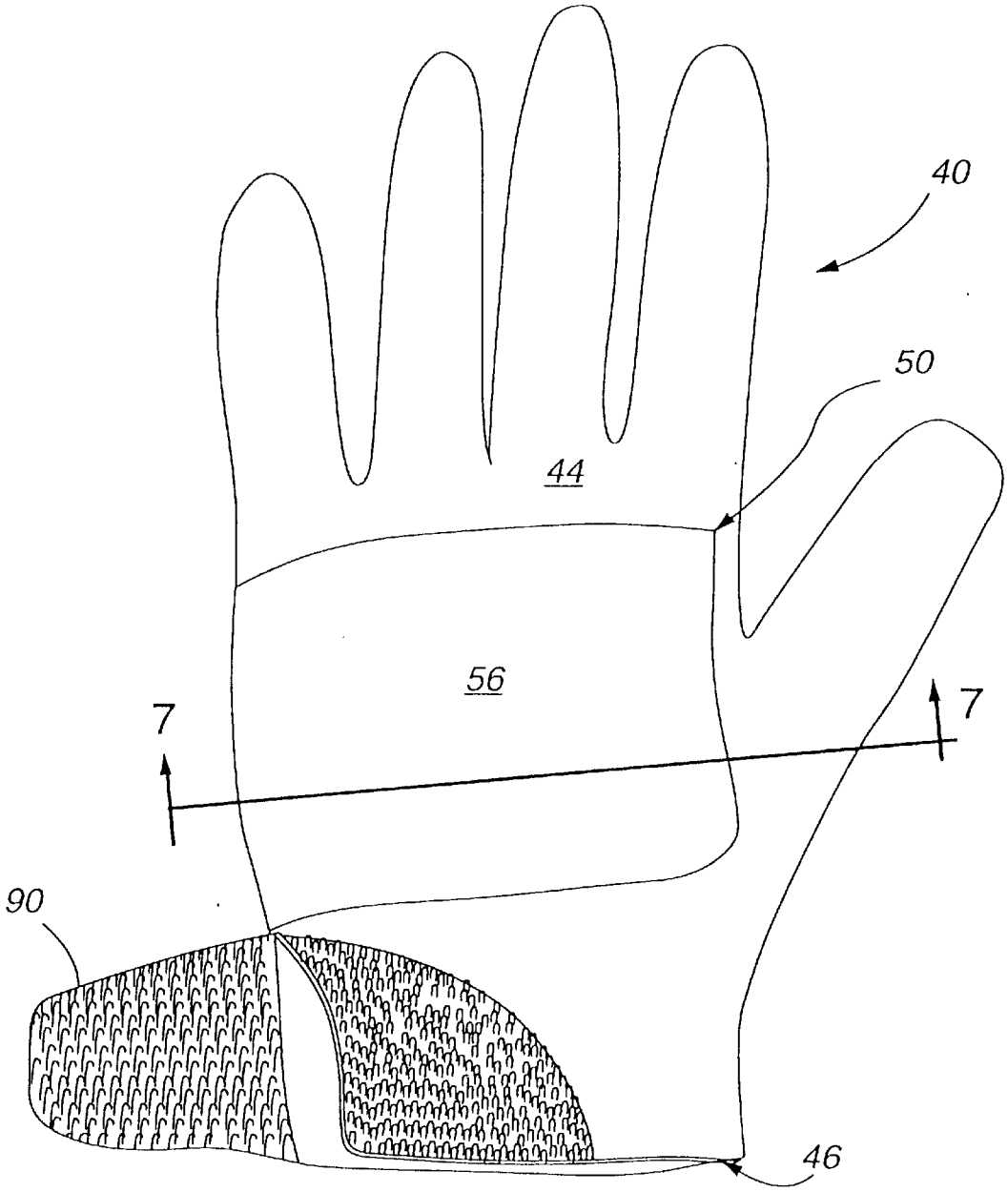
FIG. 5 is a top plan view of a protective glove according to the present invention.
Figure 6:
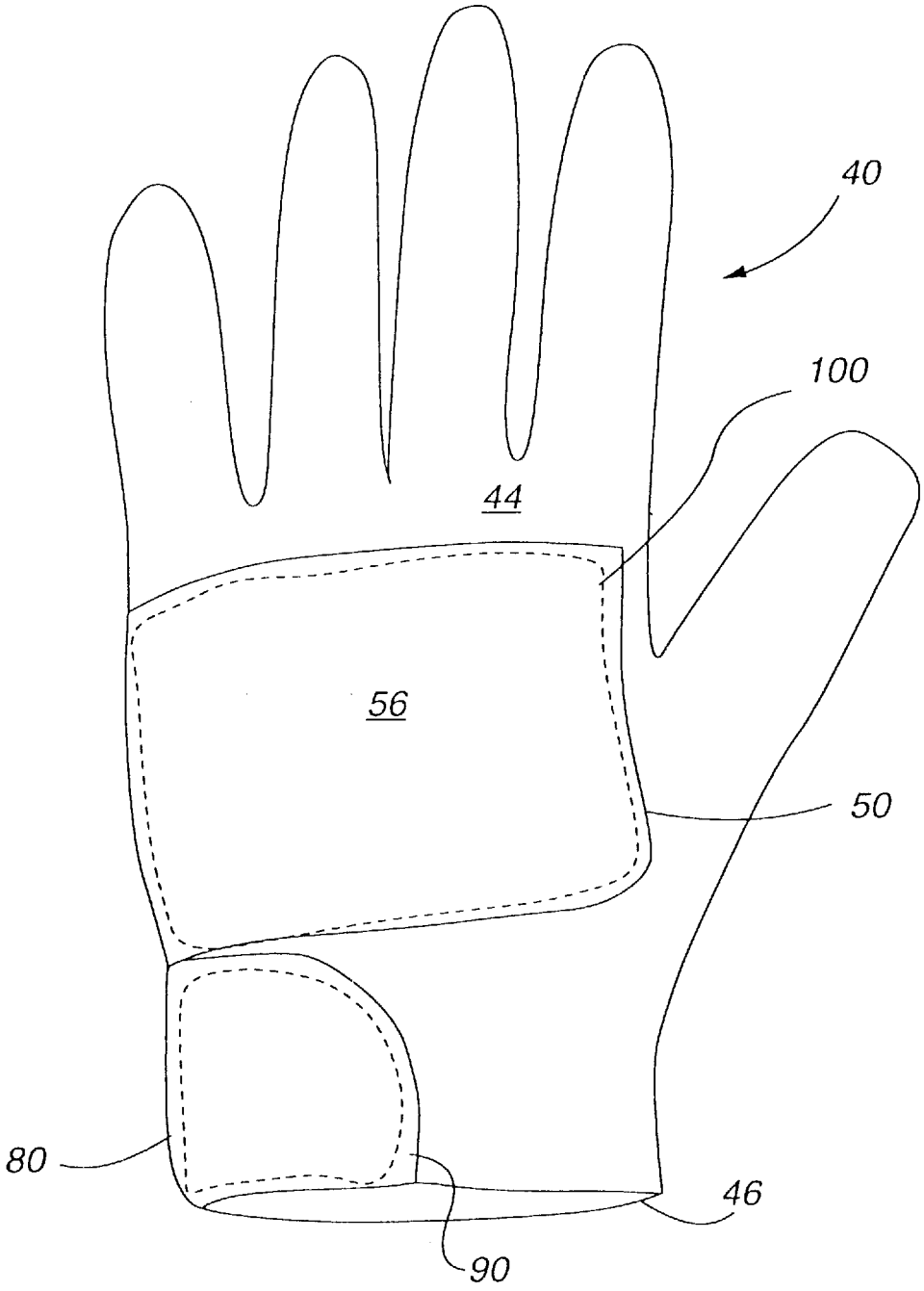
FIG. 6 is a top plan view of a protective glove illustrated in FIG. 5 showing a hand plate and a wrist plate in phantom lines and a wrist strap secured about a back glove portion of the glove.
Figure 7:
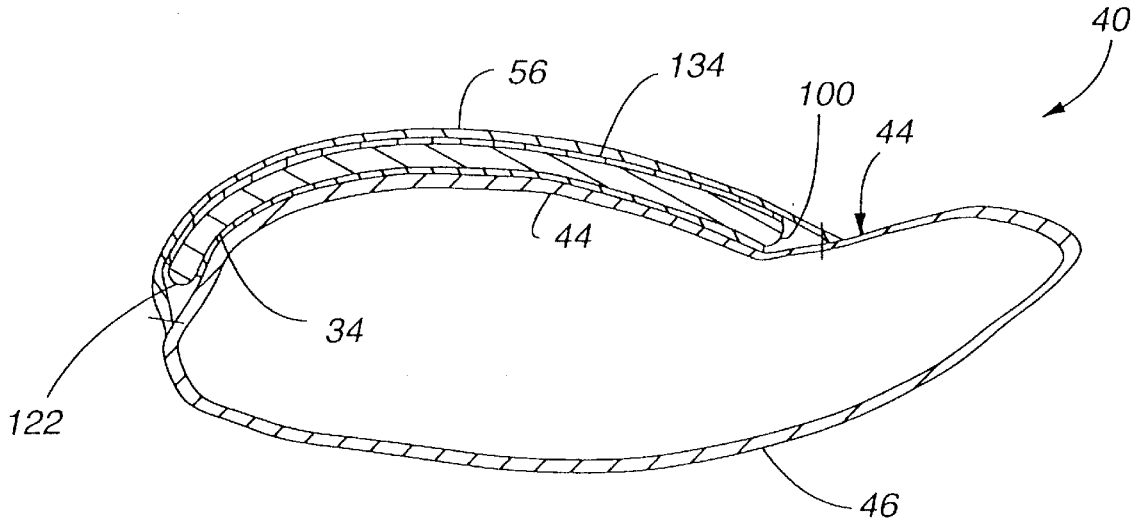
FIG. 7 is a cross-sectional view of the protective glove illustrated in FIG. 5.

In another aspect, illustrated in FIGS. 5–7, a glove for protecting at least a back portion of an individual's hand from impact forces is provided. Such gloves may be especially useful in athletic events in which contact with an object may occur. For instance, such gloves may be utilized by baseball batters to protect the back side of the hand from pitched baseballs. In one embodiment, the glove 40 includes a back glove portion 44 covering at least a metacarpal area on the back side of the hand, a malleable, manually deformable metal plate 100 configured to cover at least the fourth and fifth metacarpal bones of the hand and a holding member for securing the metal plate 100 on the back glove portion 44. The back glove portion 44 generally supports the plate 100 and may be fabricated from soft leather or a polymer (e.g., vinyl compound). In order to enhance a batter's grip on a baseball bat and to partially alleviate discomfort to the batter associated with striking the baseball with the bat, the glove 40 may further include a front glove portion 46, which may be sewn to the back glove portion 44.

Substantially as described hereinabove, the manually deformable metal plate 100 is configured to cover and protect at least the fourth and fifth metacarpal bones of the hand and may be sized to protect the first through fifth metacarpal bones. Furthermore, the plate 100 is readily deformable such that the plate 100 may generally conform to contours of the back side of an individual's hand. In a preferred embodiment, the plate 100 is comprises a soft metal, such as aluminum or aluminum alloys, and has a yield strength of less than about 60 ksi, and, more preferably, less than about 40 ksi. As such, a side edge 122, illustrated in FIG. 7, is easily bendable about the lateral portion of the fifth metacarpal bone to protect the lateral aspect of the fifth metacarpal bone from impact forces.

The holding member generally functions to secure the metal plate 100 on the back glove portion 44 of the glove 40. In one embodiment, illustrated in FIGS. 5–7, the holding member includes a sleeve 50, which is configured to receive and hold the plate 100 on the back glove portion 44. In this regard, the sleeve 50 functions as a pocket for retaining the plate 100 therein. The sleeve 50 can include at least one flexible sheet 56 having side edges and top and bottom edges. Furthermore, the sleeve 50 may be sized to retainably secure the plate 100 on the back glove portion 44 by engaging the plate 100 about at least portions of the upper and lower surfaces of the plate 100. In addition, the sleeve 50 may be configured to engage the plate 100 along at least one of the side edges and one of the top and bottom edges of the plate 100.

In one embodiment, illustrated in FIGS. 5–7, the sleeve 50 includes a single flexible sheet 56 attachable to the back glove portion 44 along the side edges and at least one of the top and bottom edges of the sheet 56. In this regard, a pocket for securably retaining the plate 100 therein is formed by the sheet 56 and the back glove portion 44. The single flexible sheet 56 may be attached to the back glove portion 44 about at least the fourth and fifth metacarpal bones to protect this region of the back side of an individual's hand. In one embodiment, the sleeve 50 may include at least a first flexible sheet 56 which is stitched to the back glove portion 44 along the side edges and at least one of the top and bottom edges of the sheet 56 to form a pocket for retaining the plate 100 therein. In another embodiment (not shown), a sleeve 50 may include first and second sheets 56 stitched along side edges and at least one of the top and bottom edges to form a pocket for retaining the plate 100 therein. In this alternative embodiment, the sleeve 50 may be affixed or releasably attachable to the back glove portion 44 to cover at least the fourth and fifth metacarpal bones. In order to facilitate insertion of the device into the sleeve 50, the sheet 56 may be fabricated from a flexible material, such as leather and textiles, such as cotton, lycra, spandex, or nylon.

Figure 8:
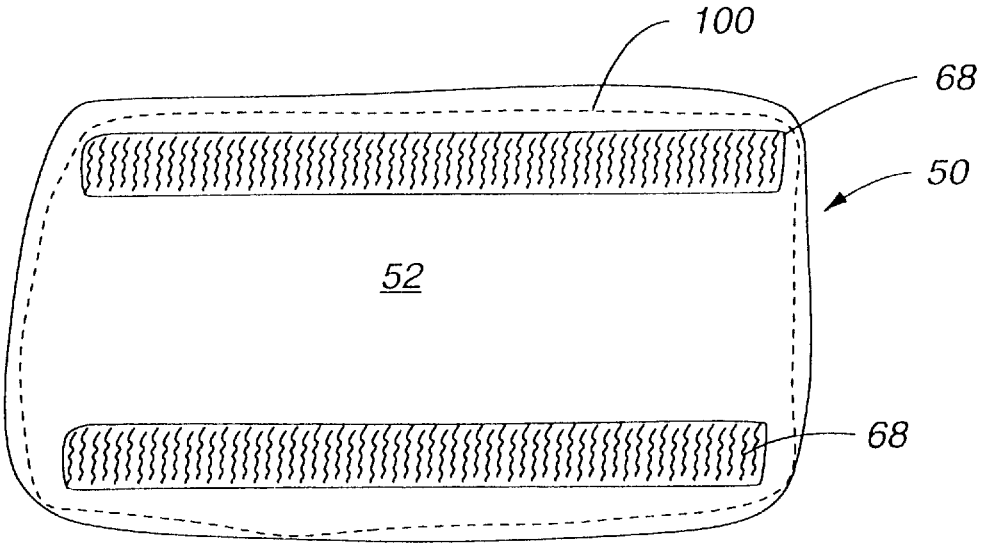
FIG. 8 is a bottom plan view of a sleeve attachable to a protective glove and showing a hand plate in phantom lines retained therein.
Figure 9:
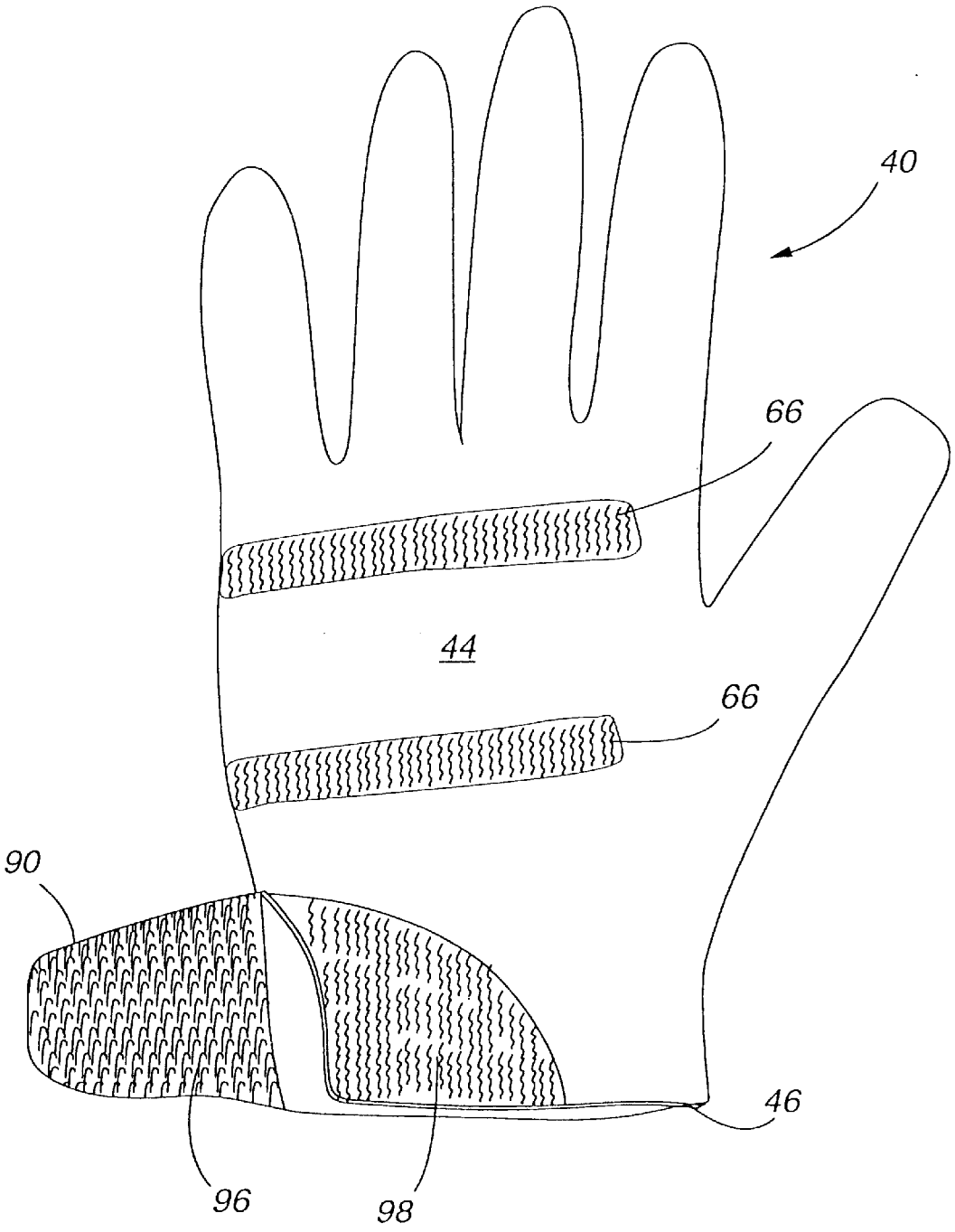
FIG. 9 is a top plan view of an embodiment of the protective glove having a plurality of Velcro-type loops for securing a hand plate or sleeve having a hand plate retained therein on the back glove portion.

In instances where the sleeve 50 is built in or affixed to the back glove portion 44, the sleeve 50 may be attachable to the back glove portion 44 via one or more securing members, such as stitching, glue, pins, staples, and clips. In another embodiment, for purposes of facilitating use of the glove 40, the securing member may include a selectively releasable fastener, such as Velcro, snaps, straps or a temporary adhesive. For example, as illustrated in FIGS. 8–9, the sleeve 50 configured to retain a plate 100 therein may be releasably attached to the back glove portion 44 by a hook and loop type fastener (e.g., Velcro). In this regard, the back glove portion 44 may comprise a plurality of loops 66 and a lower surface 52 of the sleeve 50 may comprise a plurality of hooks 68 for selectively engaging the loops 66 of the back glove portion 44. Alternatively, the back glove portion 44 may comprise a plurality of hooks which are releasably engagable with a plurality of loops on the lower surface of the sleeve 50 (not shown).

Figure 10:
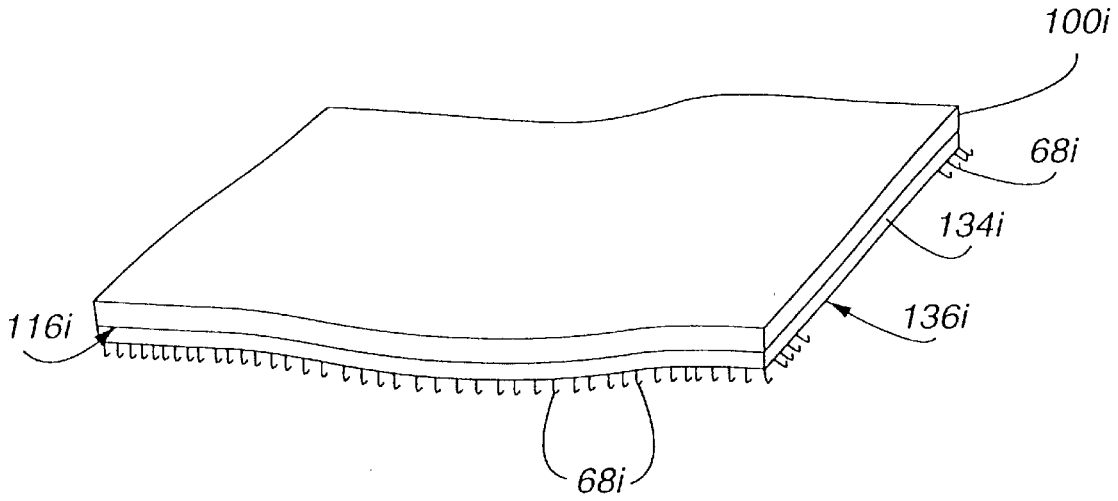
FIG. 10 is a perspective view of an embodiment of the hand plate having a plurality of Velcro-type hooks for securing the plate directly to the back glove portion illustrated in FIG. 9.

In another embodiment, illustrated in FIG. 10, the holding member may be associated with at least one of the plate $\mathbf{100}_i$ and the back glove portion 44, shown in FIG. 9. In order to reduce any perceived bulkiness associated with a sleeve 50 on the back glove portion 44, the plate $\mathbf{100}_i$ may be directly attachable, and preferably, releasably attachable, to the back glove portion 44 shown in FIG. 9. In this regard, the holding member may include at least one releasable fastener interconnected to one of the upper and lower surfaces of the plate $\mathbf{100}_i$, such as snaps, Velcro or a temporary adhesive. Referring to FIG. 10, in one embodiment, the hand protection device includes a plate $\mathbf{100}_i$ and a cushioning substrate $\mathbf{134}_i$ attached to the lower surface $\mathbf{116}_i$ of the plate $\mathbf{100}_i$. For purposes of attaching the hand protection device to a back glove portion 44, shown in FIG. 9, the lower surface $\mathbf{136}_i$ of the cushioning substrate $\mathbf{134}_i$ may comprise a plurality of hooks 68 which are engagable to a plurality of loops 66 on the back glove portion 44. In this regard, the plate $\mathbf{100}_i$ may be releasably interconnected to the glove 40.

For purposes of protecting at least a portion of the wrist (e.g., carpal bones and distal ulna and radius bones) of an individual from impact forces, in another embodiment of the invention, illustrated in FIGS. 5–6, the glove 40 may comprise a wrist protector 80 capable of at least partially absorbing and distributing impact forces. Substantially as illustrated in FIGS. 5–6, the wrist protector 80 is attachable to the glove 40. In one embodiment, the wrist protector 80 is retained within a wrist strap 90, which is typically connected to the glove 40 via stitching. In this regard, for purposes of protecting a portion of an individual's wrist proximate (e.g., proximal) the metacarpal bones, the wrist protector 80 is positionable about such a wrist portion when an individual wearing the glove 40 secures the glove 40 on the hand by tightening the strap 90 about the wrist, as illustrated in FIG. 6.

Figure 11:
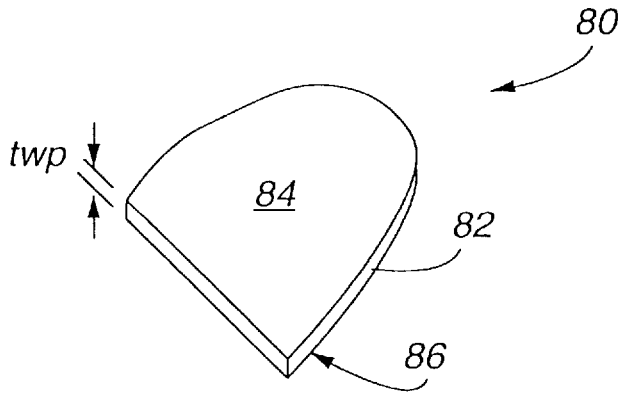
FIG. 11 is a perspective view of a wrist plate according to the present invention.

In one embodiment, shown in FIG. 11, the wrist protector 80 includes a wrist plate 82. For purposes of providing a lightweight wrist plate 82 capable of absorbing and distributing impact forces, the wrist plate 82 may be fabricated from a thin sheet of metal, plastic, leather or foam. Furthermore, for purposes of providing a wrist plate 82 capable of conforming to a contour in a wrist portion of an individual, the wrist plate 82 may be fabricated from a flexible material, such as a soft metal, leather or foam. In a preferred embodiment, the wrist plate 82 is fabricated from a thin sheet of soft metal which is capable of absorbing and distributing over a broad area impact forces and which is easily and readily bendable (e.g., deformable without fracture) such that the wrist plate 82 is conformable to contours in a wrist portion of an individual (i.e., custom fittable). The wrist plate 82 may thus be fabricated from a thin sheet of malleable metal, and may have a yield strength of less than about 60 ksi, and, in a preferred embodiment, less than about 40 ksi. In this regard, the wrist plate 82 may be fabricated from a thin sheet of a soft metal (e.g., aluminum, aluminum alloys, magnesium and combinations thereof). In a preferred embodiment, the wrist plate 82 is a thin sheet of aluminum having a thickness "$t_{wp}$", as defined by upper and lower surfaces 84, 86, of at least about 0.005 inches, and more preferably, at least between about 0.005 inches and 0.025 inches. In this regard, the wrist plate 82 is readily conformable to the contour in the wrist portion of an individual and does not substantially inhibit hand and wrist motions (e.g., grasping and swinging an object, such as a bat, racquet or stick).

Figure 12:
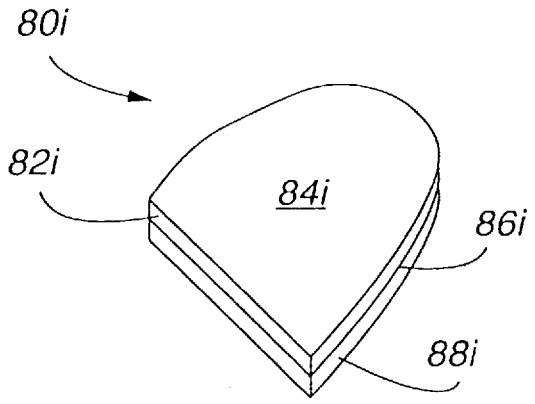
FIG. 12 is a perspective view of another embodiment of a wrist plate.
Figure 13:
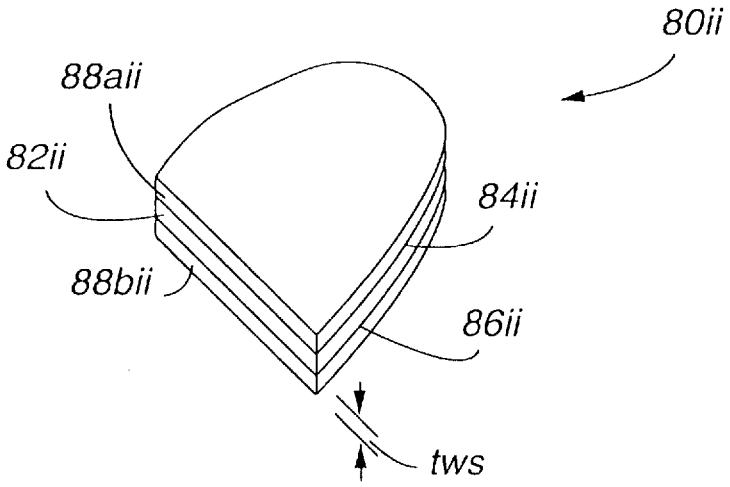
FIG. 13 is a perspective view of yet another embodiment of a wrist plate.

In order to provide increased comfort and absorbability of impact forces, the wrist protector 80 may further comprise at least one padding member attachable to at least one of the upper and lower surfaces 84, 86 of the wrist plate 82. As illustrated in FIG. 12, in one embodiment, the padding member includes a substrate of cushioning material $\mathbf{88}_i$, which is attached via a flexible adhesive to the lower surface $\mathbf{86}_i$ of the wrist plate $\mathbf{82}_i$. In this regard, increased comfort is provided to the individual as the wrist cushioning substrate $\mathbf{88}_i$ is interposed between the wrist plate $\mathbf{82}_i$ and the wrist portion of the individual. In another embodiment, illustrated in FIG. 13, the wrist protection device $\mathbf{80}_{ii}$ comprises wrist cushioning substrates $\mathbf{88}a_{ii}$, $\mathbf{88}b_{ii}$, which are attached via a flexible adhesive to the upper and lower surfaces $\mathbf{84}_{ii}$, $\mathbf{86}_{ii}$ of the wrist plate $\mathbf{82}_{ii}$. In this embodiment, the wrist cushioning substrates $\mathbf{88}a_{ii}$, $\mathbf{88}b_{ii}$ function to partially absorb impact forces and to provide increased comfort to the user.

Substantially as described hereinabove with respect to the cushioning substrates 34 interconnectable to the hand plate 10, wrist cushioning substrates 88 comprise a flexible resilient material capable of at least partially absorbing impact forces. In this regard, the wrist cushioning substrates 88 are fabricated from a flexible material, such as foam, leather, textile and plastic. In a preferred embodiment, the substrates 88 is fabricated from a resilient, flexible material, such as a foam, which may be either a closed-cell type of an open-cell type (e.g., polyurethane, neoprene, urethane foam (e.g., microcellular), expanded ethylene acetate microfoam material and ethyl vinyl acetate). Furthermore, the substrates 88 may have a thickness "$t_{ws}$" of at least about 0.03125 inches, and, in a preferred embodiment, at least about 0.125 inches.

For purposes of positioning the wrist protection device 80 over a wrist portion of an individual, the wrist protection device 80 may be associated with the glove 40 via an attaching member. In one embodiment, the attaching member includes a wrist strap 90. Such wrist straps 90, illustrated in FIGS. 5–6, facilitate insertion and removal of an individual's hand into and from the glove 40. The wrist protection device 80 may be contained (e.g., retained) within a pocket which forms the wrist strap 90. In this regard, the wrist protection device 80 is positionable over a wrist portion of an individual as the wrist strap 90 releasably engages the back glove portion 44 of the glove 40 via a wrist securing member. Thus, the wrist protection device 80 is positionable over a portion of an individual's wrist as the wrist strap 90 is tightened (e.g., pulled) about a wrist portion of the individual and engaged to the back glove portion 44 via a wrist securing member, which secures the glove 40 about the hand and wrist portion of the individual. The wrist strap 90 may include at least one flexible sheet of material (e.g., leather, spandex, lycra, nylon) which is stitched about at least three edges to retain the wrist protection device 80 therein. Alternatively, where the wrist strap 90 includes a single sheet of material (e.g., leather, spandex, lycra, nylon), the wrist protection device 80 may be attached to the wrist strap via a fastener, such as Velcro, a snap or an adhesive.

The member for releasably securing at least a portion of the wrist strap 90, and specifically, the portion of the wrist strap 90 containing the wrist protection device 80, to the back glove portion 44 may include a releasable fastener, such as Velcro, snaps, straps with receivers or a temporary adhesive. In a preferred embodiment, the securing member includes a hook and loop type fastener (e.g., Velcro). More specifically, a plurality of loops 96 attached to a surface of the strap 90 may releasably engage a plurality of hooks 98 attached to the back glove portion 44, illustrated in FIGS. 5–6. In this regard, wrist protection device 80 associated with the wrist strap 90 may be selectably positioned over a wrist portion of an individual.

In an alternative embodiment (not shown), the wrist protection device 80 may be directly attached to the back glove portion 44 proximate (e.g., proximal) a wrist portion of the individual via an attaching member. The attaching member for securing the wrist protection device 80 to the back glove portion 44 of the glove 40, proximate (e.g., proximal) a wrist portion of the individual, may comprise a fastener, such as stitching, snaps, Velcro, straps and adhesives. In a preferred embodiment, the attaching member comprises a selectively releasable fastener. Preferably, a plurality of loops are attached to the back glove portion 44 proximate the wrist portion to be protected and a plurality of hooks are attached to a lower surface of the wrist protection device 80. In this regard, the wrist protection device 80 is releasably securable to the glove 40.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A glove for protecting at least a metacarpal area of a hand of a person by at least partially absorbing and distributing impact forces, said glove comprising:

a deformable metal plate conformed to cover at least the metacarpal area of the hand, said plate having upper and lower surfaces extending between laterally displaced side edges and longitudinally displaced top and bottom edges, wherein said side edges extend at least over fourth and fifth metacarpal bones of the hand, wherein said plate has a yield strength of less than about 60 ksi such that said plate is manually deformable to substantially conform to a contour of the metacarpal area of the hand of the person;

a securing means, associated with said deformable metal plate, for holding said deformable metal plate over the metacarpal area of the hand;

at least one flexible substrate attachable to at least one of said upper and lower surfaces of said plate; and a wrist protection means for protecting a wrist portion of the person, said wrist protection means comprising a wrist plate having upper and lower surfaces, said wrist plate being engagable an said securing means to cover said wrist portion.

2. A glove, as claimed in claim 1, wherein said flexible substrate comprises a material selected from the group consisting of foam, leather, textile and plastic.

3. A glove, as claimed in claim 1, wherein said plate comprises a sheet of metal selected from the group consisting of aluminum, aluminum alloys, magnesium and combinations thereof.

4. A glove, as claimed in claim 1, wherein said securing means comprises a sleeve and a back glove portion covering the metacarpal area of the hand, said sleeve being attachable to said back glove portion, wherein said sleeve is configured to receive said deformable metal plate.

5. A glove as claimed, in claim 1, wherein said securing means comprises a pocket for retaining said deformable metal plate therein, said pocket being attachable to a back side of said glove to cover the metacarpal area of the hand.

6. A glove, as claimed in claim 1, wherein said plate has a thickness defined by said upper and lower surfaces of between about 0.005 inches and about 0.025 inches.

7. A glove for protecting at least a back portion of a hand of an individual, comprising:

a back glove portion covering at least a metacarpal area on the back portion of the hand;

a bendable metal plate conformable to cover at least fourth and fifth metacarpal bones of the hand, said plate having upper and lower surfaces extending between laterally displaced side edges and longitudinally displaced top and; and bottom edges, wherein said plate has a yield strength of less than about 60 ksi such that said plate is manually deformable to substantially conform to a contour of the metacarpal area of the hand of the individual;

holding means, attachable to at least one of said back glove portion and said plate, for securing said plate on said back glove portion;

a first cushioning substrate attachable to one of said upper and lower surfaces of said plate; and wrist protection means for protecting a wrist portion of the individual, said wrist protection means comprising a wrist plate having upper and lower surfaces, said wrist plate being engagable on said back glove portion to cover said wrist portion.

8. A glove, as claimed in claim 7, wherein said first cushioning substrate comprises a flexible material selected from the group consisting of foam, leather, plastic and cloth.

9. A glove, as claimed in claim 8, wherein said foam comprises a material selected from the group consisting of polyurethane, neoprene, ethyl vinyl acetate, microcellular urethane foam and expanded ethylene acetate microfoam.

10. A glove, as claimed in claim 8, further comprising:

a second cushioning substrate attachable to the other of said upper and lower surfaces of said plate.

11. A glove, as claimed in claim 7, wherein said plate comprises a sheet of metal selected from the group consisting of aluminum, aluminum alloys, magnesium and combinations thereof.

12. A glove, as claimed in claim 7, wherein said holding means comprises at least one fastener selected from the group consisting of stitching, snaps, straps, Velcro and adhesives.

13. A glove, as claimed in claim 7, wherein said holding means comprises a sleeve on said back glove portion, wherein said sleeve is configured to receive said plate.

14. A glove, as claimed in claim 13, wherein said sleeve comprises at least one flexible sheet attachable to said back glove portion via a securing means.

15. A glove, as claimed in claim 14, wherein said flexible sheet comprises a material selected from the group consisting of foam, leather, plastic and cloth.

16. A glove, as claimed in claim 14, wherein said securing means comprises at least one selectively releasable fastener.

17. A glove, as claimed in claim 14, wherein said securing means comprises a fastener selected from the group consisting of stitching, Velcro, snaps, straps and adhesives.

18. A glove, as claimed in claim 7, wherein said wrist plate comprises a soft metal having a yield strength of less than about 60 ksi.

19. A glove, as claimed in claim 7, wherein said wrist plate comprises a sheet of soft metal selected from the group consisting of aluminum, aluminum alloys and magnesium and combinations thereof.

20. A glove, as claimed in claim 7, wherein said wrist protection means further comprises a cushioning wrist substrate attached to at least one of said upper and lower surfaces of said wrist plate.

21. A glove, as claimed in claim 20, wherein said cushioning wrist substrate comprises a flexible material selected from the group consisting of foam, leather, plastic and cloth.

22. A glove, as claimed in claim 7, further comprising:

a wrist strap attached to the glove for selectively securing the glove about the hand of the individual, said wrist strap being releasably engagable on said back glove portion, wherein said wrist plate is associated with said wrist strap.

23. A glove, as claimed in claim 7, further comprising:

a front glove portion covering at least a palm portion of the hand, wherein said front and back glove portions are attached to cover at least the palm and metacarpal portions of the hand.

24. A glove for protecting at least a wrist of an individual, comprising:

front and back glove portions covering at least a portion of the front and back sides of a hand, respectively;

a deformable metal plate conformed to cover at least the metacarpal area of the hand;

a bendable metal wrist plate conformable to cover at least a portion of the wrist, said plate having upper and lower surfaces, wherein said plate has a yield strength of less than about 60 ksi such that said plate is manually deformable to substantially conform to a contour of the wrist of the individual;

a first cushioning wrist substrate attachable to one of said upper and lower surfaces of said plate; and holding means, attachable to at least one of said front and back glove portions and said plate, for securing said plate on said back glove portion proximate the wrist.

25. A glove, as claimed in claim 24, wherein said first cushioning wrist substrate comprises a flexible material selected from the group consisting of foam, leather, plastic and cloth.

26. A glove, as claimed in claim 25, wherein said foam comprises a material selected from the group consisting of polyurethane, neoprene, ethyl vinyl acetate, microcellular urethane foam and expanded ethylene acetate microfoam.

27. A glove, as claimed in claim 24, further comprising:

a second cushioning wrist substrate attachable to the other of said upper and lower surfaces of said plate.

28. A glove, as claimed in claim 24, wherein said plate comprises a sheet of metal selected from the group consisting of aluminum, aluminum alloys, magnesium and combinations thereof.

29. A glove, as claimed in claim 24, wherein said holding means comprises at least one fastener selected from the group consisting of stitching, snaps, straps, Velcro and adhesives.

30. A glove, as claimed in claim 24, wherein said holding means comprises a wrist strap attached to one of said front and back glove portions, said wrist strap being capable of securing the glove on the hand about the wrist, wherein said wrist strap comprises at least one flexible sheet configured to retain said plate on the portion of the wrist via a securing means.

31. A glove, as claimed in claim 30, wherein said flexible sheet comprises a material selected from the group consisting of foam, leather, plastic and cloth.

32. A glove, as claimed in claim 30, wherein said securing means comprises at least one selectively releasable fastener.

33. A glove, as claimed in claim 30, wherein said securing means comprises a fastener selected from the group consisting of stitching, Velcro, snaps, straps and adhesives.

34. A glove, as claimed in claim 24, further comprising:

a hand plate having upper and lower surfaces for covering at least fourth and fifth metacarpal bones of the hand; and attaching means, connectable to at least one of said back glove portion and said hand plate, for securing said hand plate on said back glove portion, proximate the fourth and fifth metacarpal bones.

35. A glove, as claimed in claim 34, wherein said hand plate comprises a material selected from the group consisting of plastic, metal, leather, foam and textile.

36. A glove, as claimed in claim 34, wherein said hand plate comprises a sheet of metal having a yield strength of less than about 60 ksi.

37. A glove, as claimed in claim 34, further comprising a first cushioning hand substrate attachable to one of said upper and lower surfaces of said hand plate.

38. A glove, as claimed in claim 34, wherein said attaching means comprises at least one fastener selected from the group consisting of stitching, snaps, straps, Velcro and adhesives.

39. A glove, as claimed in claim 34, wherein said attaching means comprises a sleeve on said back glove portion, said sleeve being capable of retaining said hand plate.

40. A method for protecting at least fourth and fifth metacarpal bones of a hand of an individual, comprising the steps of:

providing a hand guard by providing:

a deformable metal plate having upper and lower surfaces extending between laterally displaced side edges and longitudinally displaced top and bottom edges, wherein said side edges extend at least over fourth and fifth metacarpal bones of the hand; said plate having a yield strength of less than about 60 ksi such that said plate is manually deformable to substantially conform to a contour of the metacarpal area of the hand of the individual;

a securing means, associated with said deformable metal plate, for holding said deformable metal plate over the metacarpal area of the hand;

at least one cushionable substrate attachable to at least one of said upper and lower surfaces of said plate; and a wrist protection means for protecting a wrist portion of the individual, said wrist protection means comprising a wrist plate having upper and lower surfaces, said wrist plate being engagable on said securing means to cover said wrist portion;

positioning the hand guard proximate the fourth and fifth metacarpal bones of the hand; and securing the hand guard about the fourth and fifth metacarpal bones of the hand using said securing means.

41. A method, as claimed in claim 40, further comprising the step of:

bending the deformable metal plate to conform to at least one contour in the metacarpal region of the hand.

42. A method, as claimed in claim 41, wherein said step of bending comprises curving at least a portion of the deformable metal plate about the fifth metacarpal bone.

43. A method, as claimed in claim 40, wherein said positioning step comprises the step of inserting at least a portion of the hand guard into a sleeve located on a back side of a glove, the hand being insertable into the glove.

44. A method, as claimed in claim 43, wherein said sleeve comprises at least one flexible sheet having laterally displaced side edges and longitudinally displaced top and bottom edges, wherein said securing step comprises the step of engaging at least a portion of said hand guard against at least one of said side edges.

45. A method, as claimed in claim 40, wherein said positioning step comprises the step of inserting the hand into a glove having a back portion, wherein the hand guard is attachable to the back portion of the glove.

46. A method, as claimed in claim 40, wherein said securing step comprises the step of wrapping a wrist strap interconnected with a glove about a wrist portion of the glove, proximate a wrist region of the individual.

* * * * *